US007395626B2

(12) United States Patent
Zedrosser

(10) Patent No.: US 7,395,626 B2
(45) Date of Patent: Jul. 8, 2008

(54) FIREARM WITH SELECTION DEVICE FOR RIGHT OR LEFT-HAND CARTRIDGE CASE EJECTION

(75) Inventor: Ulrich Zedrosser, Steyr Ortskai (AT)

(73) Assignee: Fabrica D'Armi Pietro Beretta S.p.A., Brescia (IT)

( * ) Notice: Subject to any disclaimer, the term of this patent is extended or adjusted under 35 U.S.C. 154(b) by 353 days.

(21) Appl. No.: 11/032,752

(22) Filed: Jan. 11, 2005

(65) Prior Publication Data

US 2006/0070288 A1 Apr. 6, 2006

(30) Foreign Application Priority Data

Oct. 6, 2004 (IT) ..... MI2004A1893

(51) Int. Cl.
*F41A 3/00* (2006.01)

(52) U.S. Cl. ..... 42/25

(58) Field of Classification Search ..... 42/25, 42/16

See application file for complete search history.

(56) References Cited

U.S. PATENT DOCUMENTS 3,791,060 A * 2/1974 Weaver ..... 42/16
3,882,625 A * 5/1975 Tellie ..... 42/25
3,999,318 A * 12/1976 Tellie ..... 42/106
4,416,078 A * 11/1983 Hillberg ..... 42/69.01
4,562,659 A * 1/1986 Neta ..... 42/75.03
5,305,539 A * 4/1994 Von Kuster ..... 42/75.01
6,029,385 A * 2/2000 Howell, Jr. ..... 42/59
6,560,908 B2 * 5/2003 Murello ..... 42/69.02
6,625,917 B2 * 9/2003 Murello et al. ..... 42/16
6,898,888 B2 * 5/2005 Greenhut ..... 42/18
6,966,137 B2 * 11/2005 Gussalli Beretta ..... 42/46

FOREIGN PATENT DOCUMENTS

EP 1 363 099 A 11/2003

OTHER PUBLICATIONS

European Search Report.

* cited by examiner

*Primary Examiner*—Troy Chambers
(74) *Attorney, Agent, or Firm*—James V. Costigan; Hedman & Costigan, P.C.

(57) ABSTRACT

Fire arm with selection device for right or left-hand cartridge case ejection comprising a barrel (12), a breech bolt holder slide (21), a breech bolt (18) fitted with firing pin (19) and a frame (14) fitted with openings on both sides (15) for firing the cartridge case (16), in which the selection device comprises two sliding extractors (33, 33') in housings (32) on opposite sides of the breech bolts (18) and an ejection control component (23), the extractors (33, 33') comprise an engagement terminal (34), suitable for acting on the cartridge case (16), and a shaft (36) protruding out from the back of the breech bolt (18) bearing a helical spring (37), for the intervention of the control component (23).

10 Claims, 10 Drawing Sheets

37
19
37
36
20
31
36
35
33
32
42
30
41
48
18
34
33
35
29
34a
34b
48
34c
34
25
30
25
32
11
18
32

FIREARM WITH SELECTION DEVICE FOR RIGHT OR LEFT-HAND CARTRIDGE CASE EJECTION

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

This invention refers to a firearm with a selection device for right or left-hand cartridge case ejection. At the end of the shot the cartridge case has to be ejected through a hole, or gate, made in the breech bolt and possibly in the frame of the firearm, following a trajectory that does not pose a risk to the user of the gun.

BACKGROUND OF THE INVENTION

Field of The Invention

It is a known fact that making so-called reversible guns means that they can be prepared for ejection on either side for use by right or left-handed users.

The main problem with these guns lies in their complexity and the large number of components that make up the extraction and ejection mechanism, which must be stripped down and reassembled in order to convert the gun.

This entails greater manufacturing costs, less reliability and longer, more complicated gun conversion operations.

As the invention is designed for gun experts, the following text will make general references to automatic or semiautomatic firearms, pump-action rifles and similar, without providing a detailed description of the gun's structure and operation. Reference will only be made to the functions of the gun components involved in the technical problem that lies behind the invention.

BRIEF SUMMARY OF THE INVENTION

The object of this invention is to develop a firearm with a selection device for right or left-hand cartridge case ejection which has a small number of components that are easy to assemble.

Another object of this invention is to develop a firearm with a selection device for right or left-hand cartridge case ejection which is reliable and strong.

Another object of this invention is to develop a firearm with a selection device for right or left-hand cartridge case ejection which is simple and practical, with limited costs.

The objects of this invention are achieved by developing a firearm with a selection device for right or left hand cartridge ejection comprising:

a barrel (12);

a breech bolt holder slide (21);

a breech bolt (18) fitted with firing pin (19);

a frame (14) fitted with openings on both sides (15) for ejecting the cartridge case (16); wherein said selection device comprises two sliding extractors (33, 33'), housed in housings (32) on opposite sides of the breech bolts (18);

an ejection control component (23), in which said extractors (33, 33') comprise an engagement terminal (34), suitable for acting on said cartridge case (16); and a shaft (36) protruding out from the back of said breech bolt (18) bearing a helical spring (37), for the intervention of said control component (23).

Additional features are covered by the dependent claims.

BRIEF DESCRIPTION OF THE SEVERAL VIEWS OF THE DRAWINGS

The features and advantages of a firearm with a selection device for right or left-hand cartridge ejection according to this invention will appear more clearly from the following description, which is made by way of a non-limiting example only, with reference to the attached diagrams in which.

DETAILED DESCRIPTION OF THE INVENTION

In reference to the figures, a firearm with a selection device for right or left-hand cartridge case ejection is shown, indicated by the number 10, by way of an example and is not restrictive.

Figure 1:
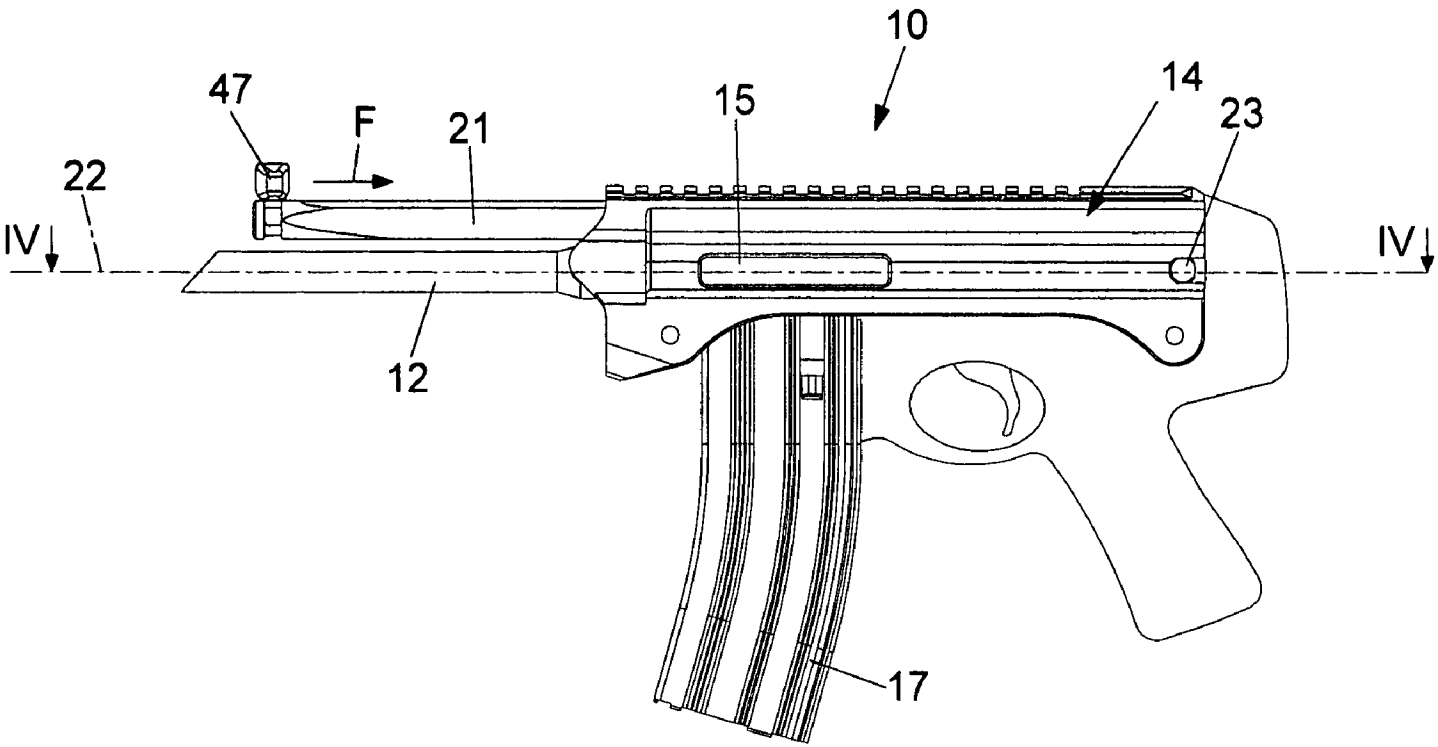
FIG. 1 is a diagram of the side view of a firearm with a selection device for right or left-hand cartridge case ejection, the subject of this invention.

The firearm 10 in FIG 1, which is illustrated by way of an example and is not restrictive, comprises a barrel 12, a breech bolt ensemble, a frame 14, or external casing, provided amongst other things with openings 15, for right or left-handed cartridge case firing, in addition to a magazine 17.

A selection device for right or left-hand cartridge case ejection is applied to the breech bolt ensemble, which comprises a breech bolt 18, a firing pin 19, fitted with a helical spring 20, a breech bolt holder slide 21 which runs parallel to an axis 22 of the barrel 12, or axis of the gun, in addition to a control component 23 for commutating the gun 10.

Figure 2:
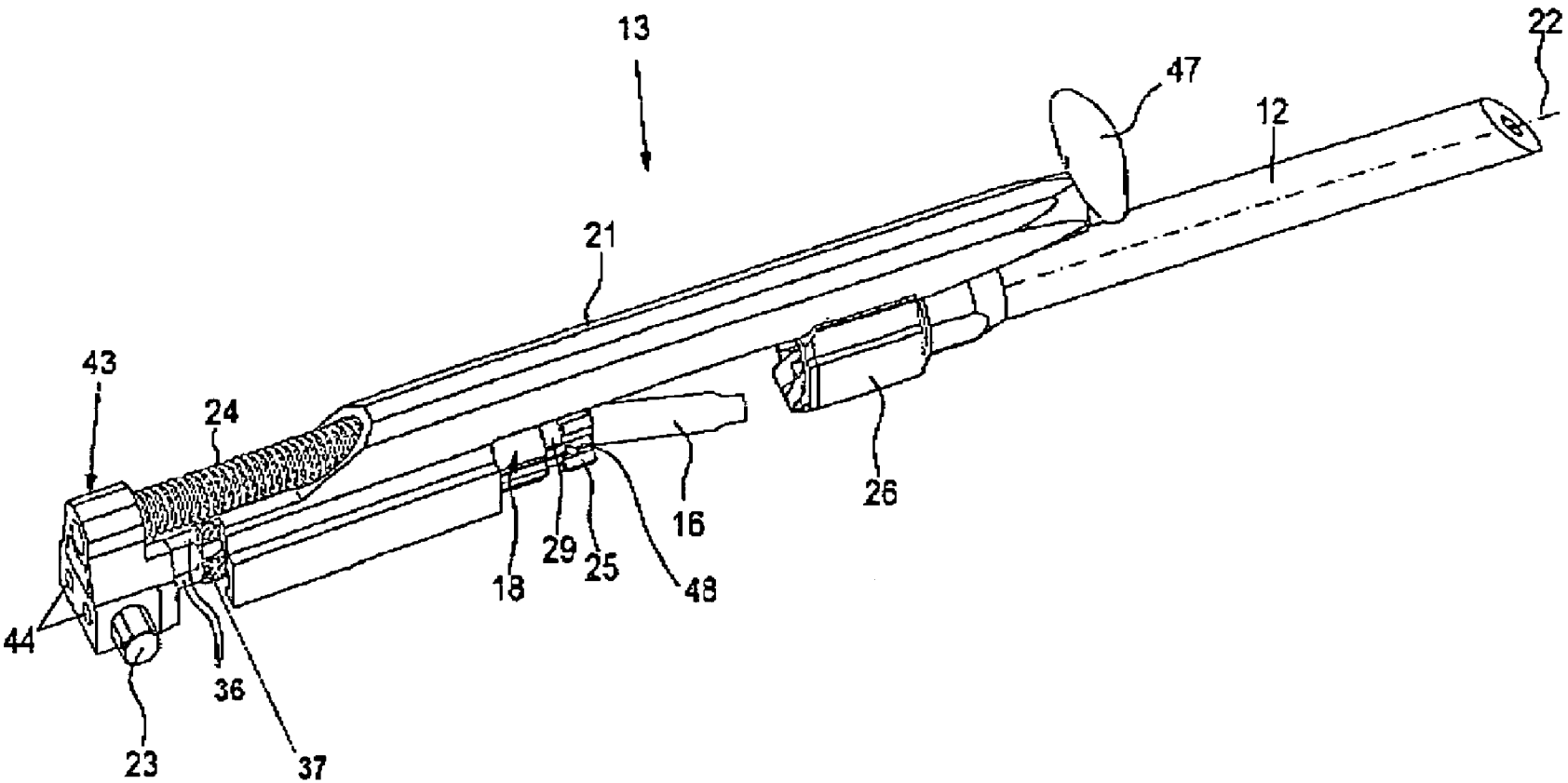
FIG. 2 is an elevation of the breech bolt ensemble of the gun in FIG. 1 during the ejection of a cartridge case.

The breech bolt holder slide 21 is fitted with helical spring on top 24 which controls the movement of the breech bolt ensemble, in addition to a cocking handle, or cock, 47, which in the example shown in FIG. 2 is assembled above the slide 21.

The breech bolt 18, which is assembled in a sliding position with respect to the slide 21, is pierced centrally in order to house the firing pin 19 and the helical spring 20. At one end, the breech bolt 18 is fitted with a head 25 that engages with a small receiver 26 built into the barrel 12 to close the cartridge chamber 27.

According to that shown by way of an example, in the figures, the barrel 12 and the small receiver 26 are connected by means of a threaded section 28.

Moreover, in the preferred, non restrictive creation of this invention, the head 25 bears a threaded band at its end adjacent to a gorge, or groove, 29. The threaded head 25 engages with a section of the matching mouth of the small receiver 26, running inside it and locking into place by means of rotation. However, other cartridge chamber 27 locking systems, known to experts in the field, such as systems based on breech bolt inertia or geometrical locks, can be used as an alternative in the firearm which is the subject of this invention.

Figures 3, 3A:
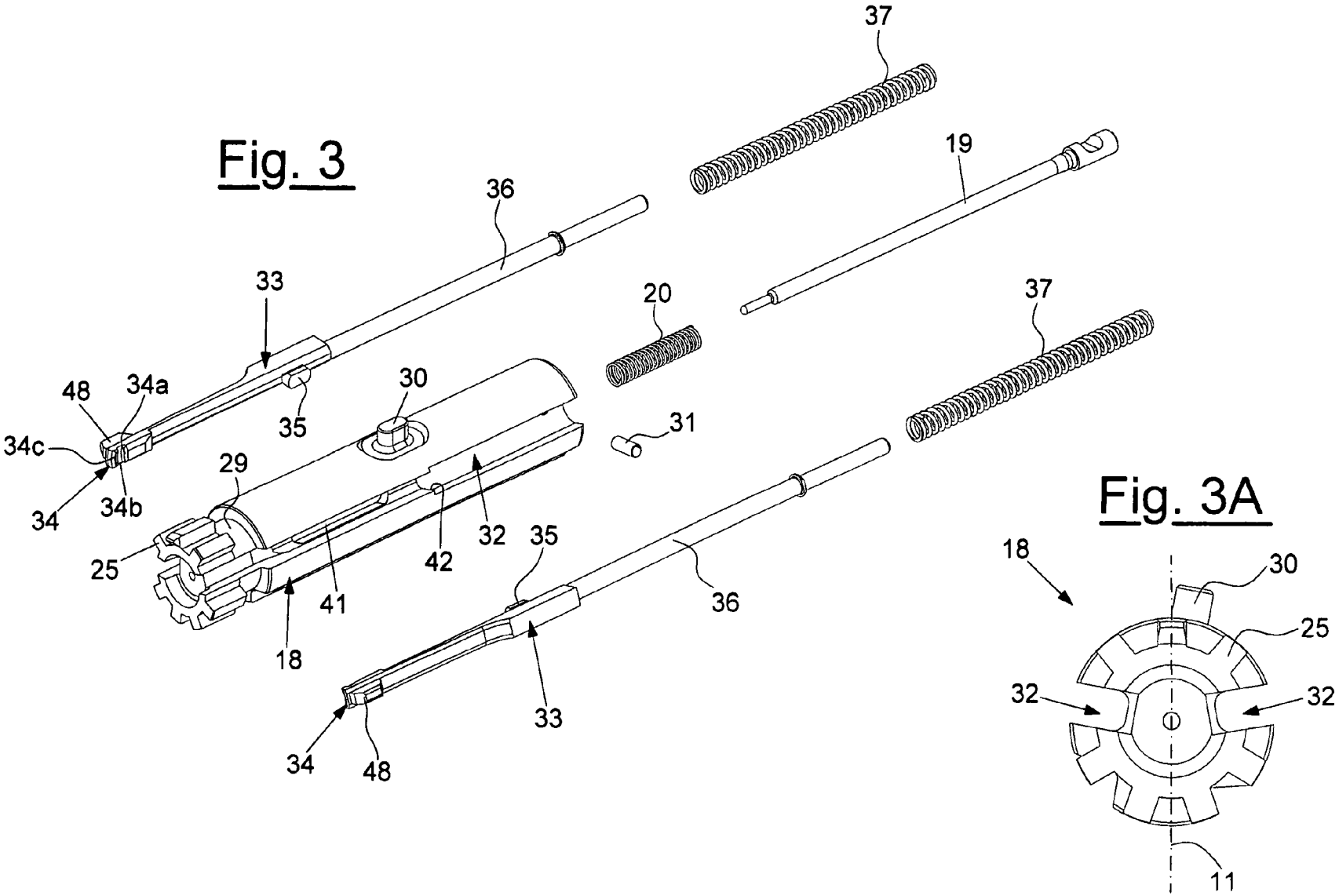
FIG. 3 is an exploded view of the breech bolt of a firearm with a selection device for right or left-hand cartridge case ejection, the subject of this invention.
FIG. 3A is an enlarged front view of the breech bolt in FIG. 3.

The breech bolt, shown in FIG. 3 in an enlarged exploded view, also bears a slider 30 in an upper position in order to suitably synchronize the movements of the breech bolt 18 with respect to those of the slide 21, and an elastic pin 31 that holds back the firing pin 19.

The breech bolt 18, as shown in the front view example in FIG. 3A, has a symmetrical construction with respect to its median surface 11 and is fitted with identical housings on the sides 32 for respectively housing extractor 33 and 33', or an ejector, shown in FIG. 3, which moves in a lengthways direction in housing 32 during the phases following the shot. Extractors 33 and 33' inserted in housings 32 are also identical.

The housings 32, in which extractor components 33 and 33' are inserted and maintained, may be positioned, as illustrated in FIG. 3A, on slightly tilted surfaces. The extractor component 33, 33' is a component with an elongated shape and comprises an engagement terminal 34 at one end and a threaded section 48, a raised surface 35, or button in a central section, which guides the sliding motion in housing 32 and, at the opposite end, a shaft 36, which is substantially cylindrical in shape and protrudes behind the breech bolt, on which a helical spring 37 is assembled.

Figure 4:
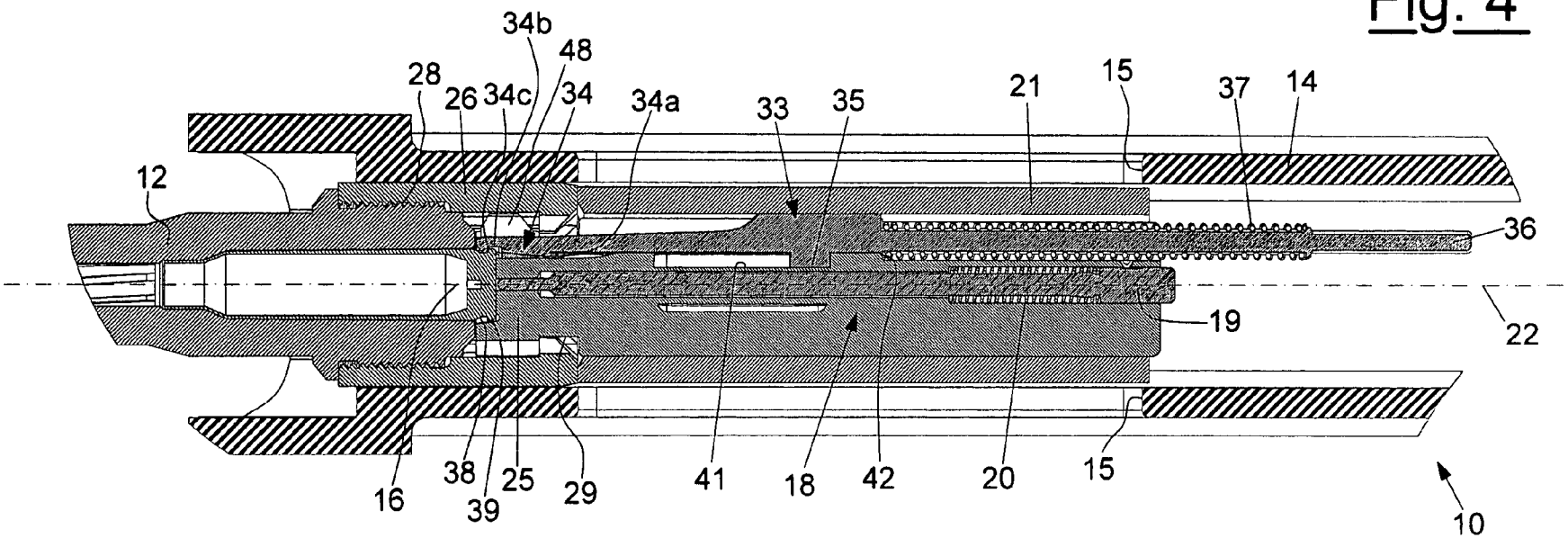
FIG. 4 is an enlarged and partially split open section of the gun in FIG. 1 made following line IV-IV, in which the head of the breech bolt is in a closed position during the shot.
Figure 5:
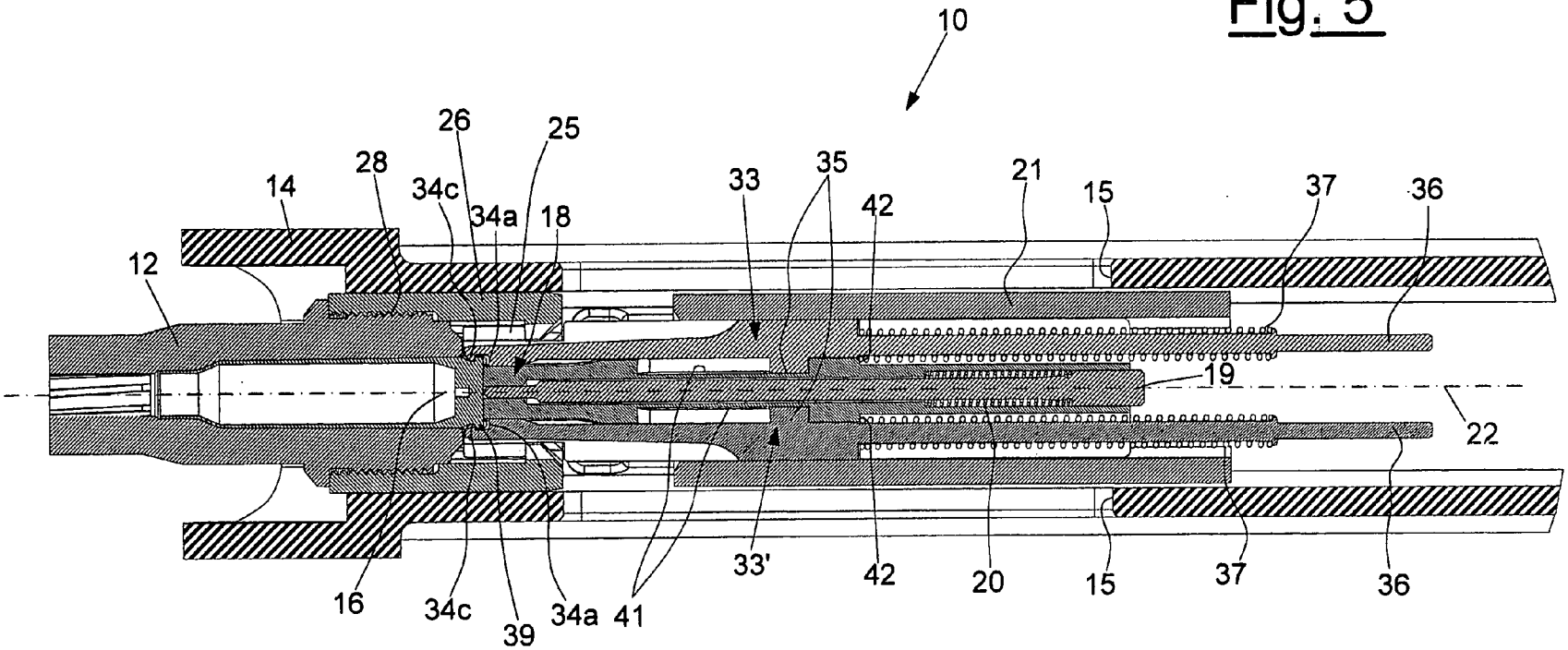
FIG. 5 shows the gun in FIG. 4, in which the head of the breech bolt is in an open position.

The threaded section 48 completes the profile of the threaded head 25 of the breech bolt 18 when the extractor 33 and 33' is positioned in housing 32 when the breech bolt is closed as in FIGS. 4 and 5.

Figure 10:
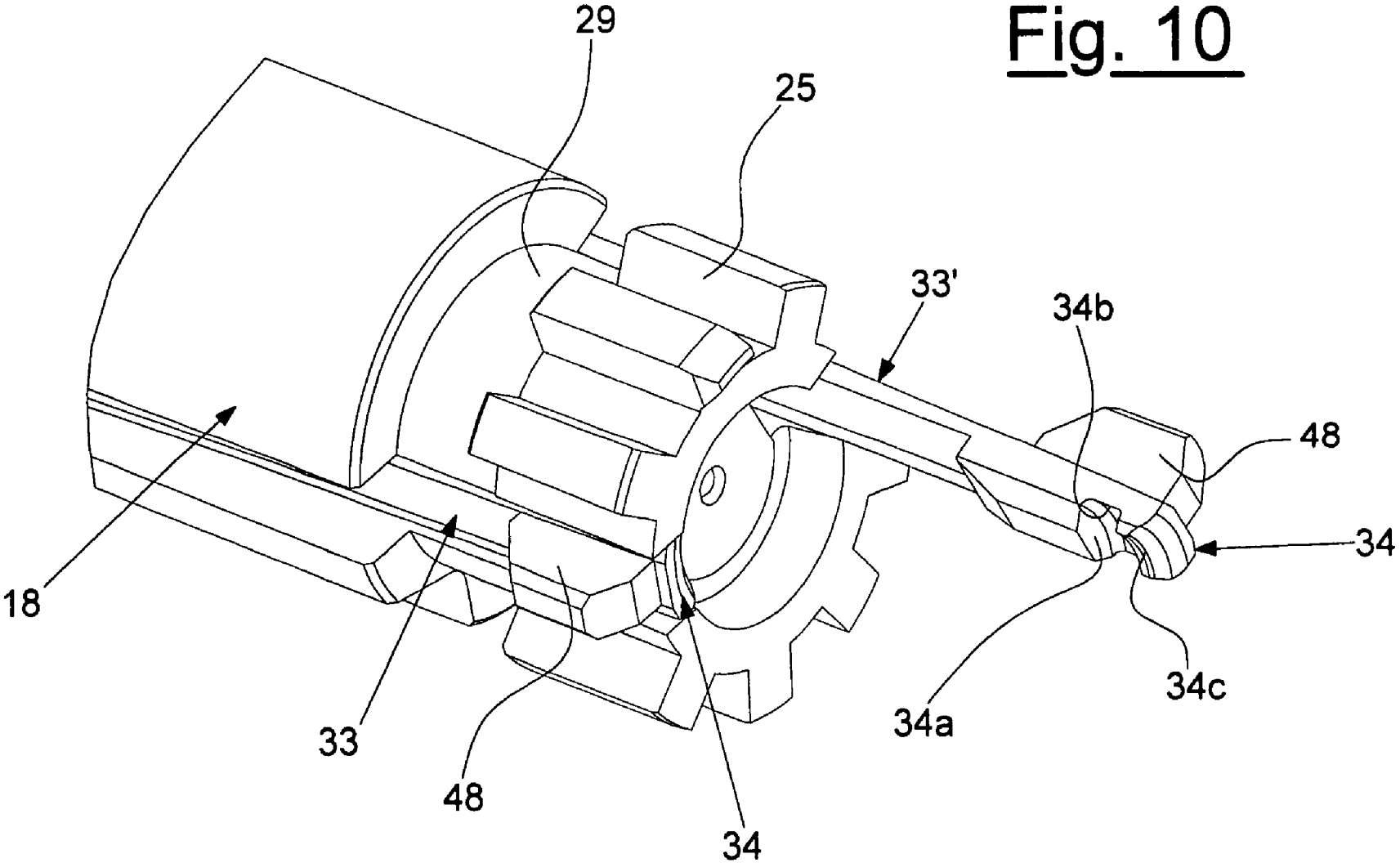
FIG. 10 is a partially split and enlarged elevation of the breech bolt in FIG. 9, with an extractor/ejector component in a protruding position.

The engagement terminal 34 comprises, as illustrated in the enlarged detail in FIG. 10, a driving surface 34*a* suitable for acting on the rim 39 of the cartridge case in order to expel it during the ejection phase, a groove 34*b* and an ejection bent 34*c*, which fits into a support ring groove 38 of the cartridge case 16, holding it in place.

Figure 6:
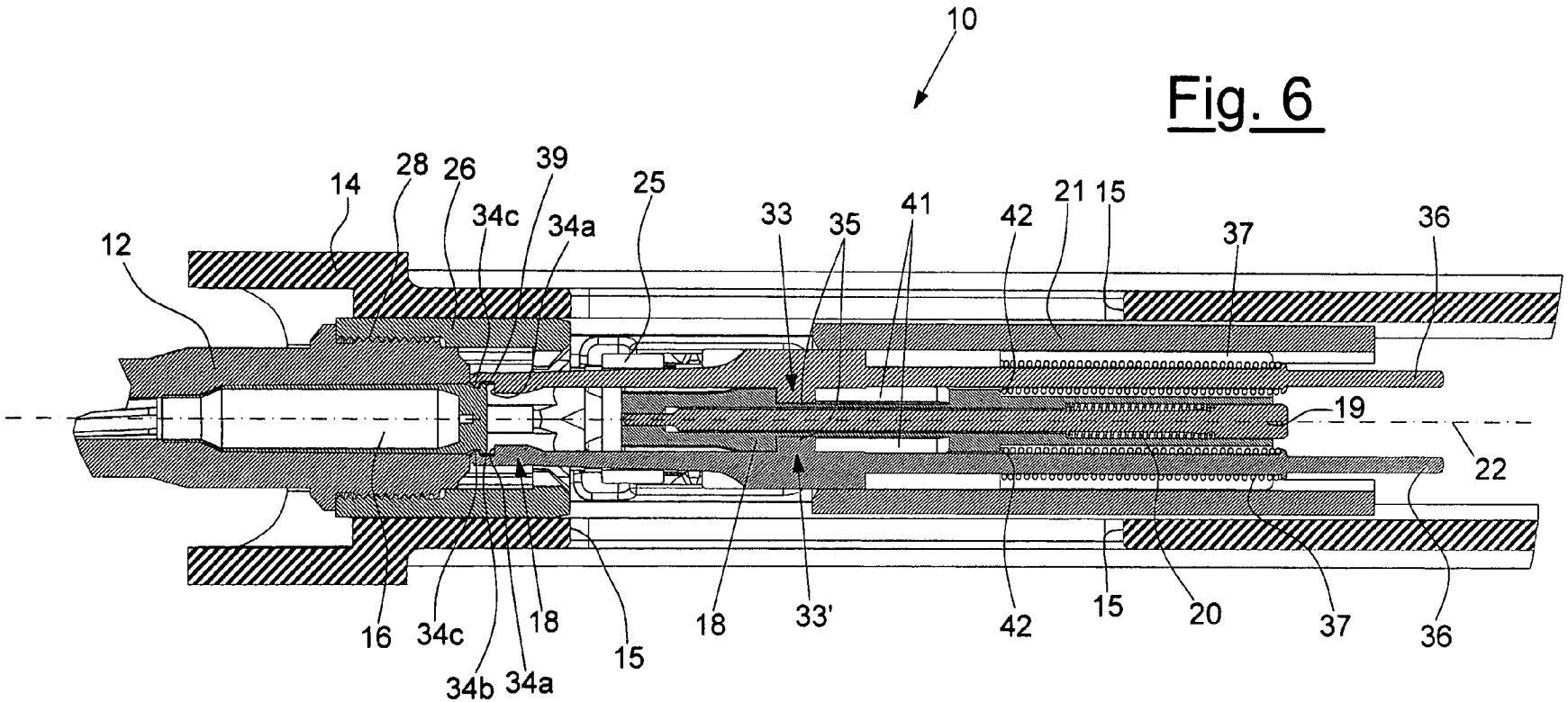
FIGS. 6 and 7 show the gun in FIG. 4 during the cartridge case extraction phase.
Figure 8:
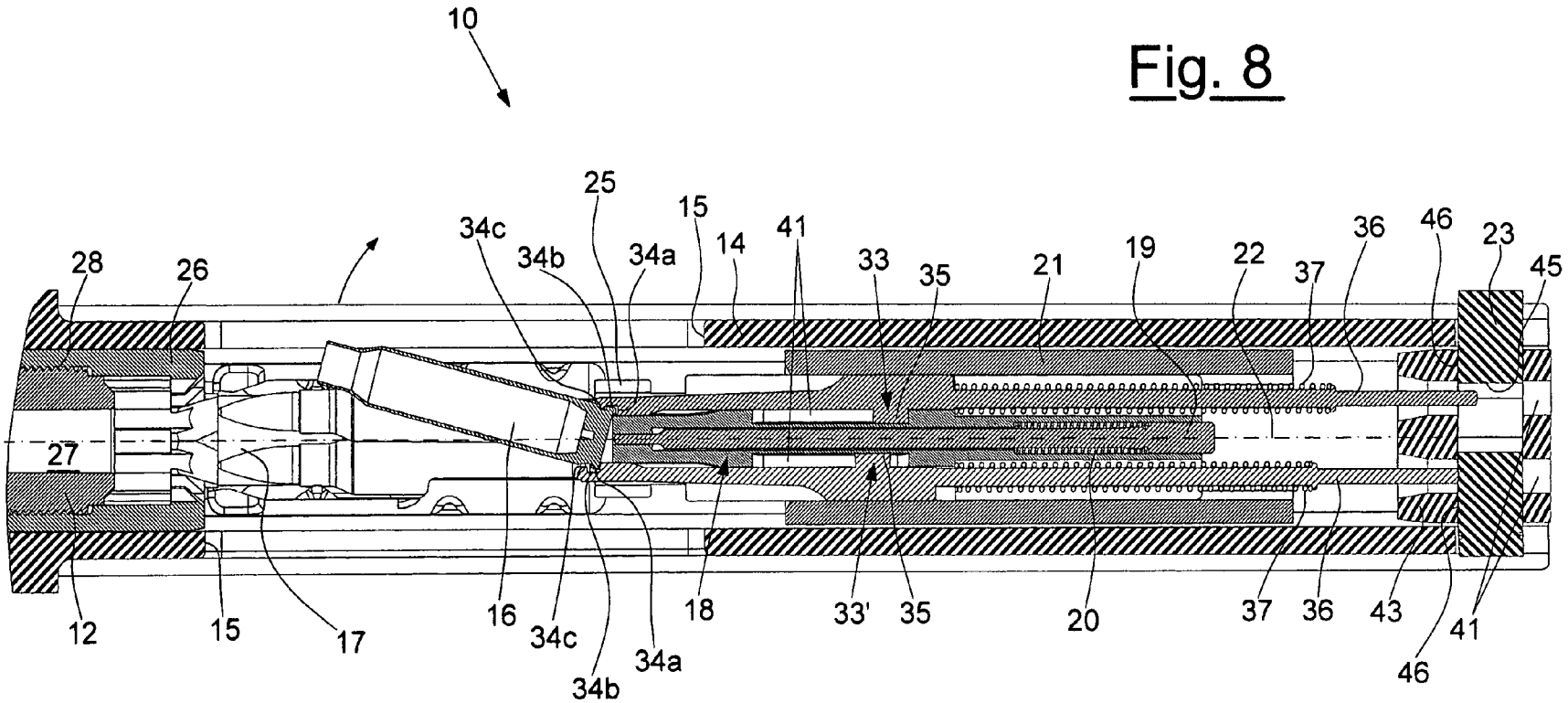
FIGS. 8 and 9 show the gun in FIG. 4 during the cartridge case ejection phase on the right-hand side.
Figure 9:
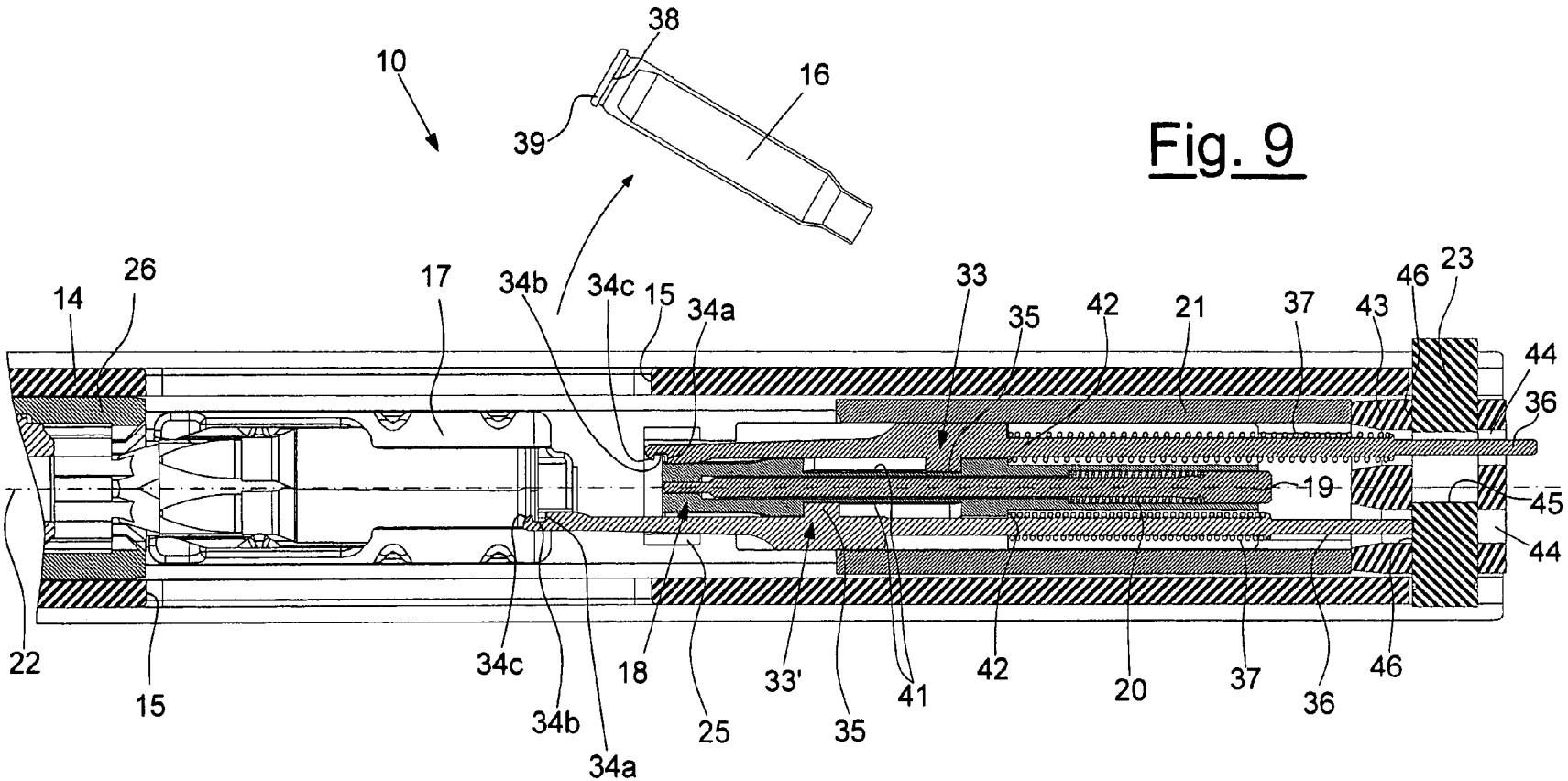

The housings 32 substantially match the extractors 33 and 33' in shape and have an elongated groove 41, through which the raised button 35 of the extractor 33 or 33' runs during the movement relative to the lengthways transfer, and an additional striking surface 42 for the spring 37 during some extraction and ejection phases, as illustrated in FIGS. 6, 8 and 9 for example.

As the gun 10 is reversible, the cartridge case 16 can be ejected from either the right-hand opening 15 or the left-hand opening 15, depending on how the control component 23 for gun commutation is positioned.

The control element 23 is a block inserted crossways into an end section 43 built into the frame 14, which the slide 21 strikes against.

The end section 43, which the slide 21 spring 24 acts on, is fitted, on the side facing the slide 21, with two through holes 44 running parallel to the axis 22 of the gun and through which end portions of shafts 36 of the extractors 33 and 33' can run freely when the slide 21 draws back.

The control component 23 is mobile and can slide within its housing and is also fitted with a hole 45 running parallel to the axis 22 of the gun, which is taken alternatively into line with shaft 36 of right-hand extractor 33, as illustrated in the figure, or that of the left-hand extractor, while a stopping surface 46 is placed in correspondence to the other extractor 33', which also acts as an ejector.

The ejection of the cartridge case 16 at the end of the firing cycle takes place after the slide 21 has drawn back in the direction of the arrow F in FIG. 1, which pulls the breech bolt 18 and the extractors 33 and 33' with it, as well as the cartridge case 16 held by the bents 34*c* of the extractors 33 and 33' following a sequence of movements described below with the help of figures from 4 to 9.

FIG. 4 depicts a firearm 10 with a selection device for right or left-hand cartridge case ejection, which is the subject of this invention, in which the head 25 of the breech bolt 18 is in a closed position during firing.

During the immediately following phases, the slide 21 starts to draw back, but it does not drag the breech bolt 18 with it, but opens it instead by means of a cam mechanism that causes the breech bolt to rotate (FIG. 5). The extractors 33 and 33' remain in the initial position inside the hollow 38 of the cartridge case 16. FIG. 6 shows the start of the extraction phase. The slide 21 draws back further, dragging the breech bolt 18 into the movement, as the threaded head 25 is now free to extract itself from the small receiver 26.

The extractors 33 and 33' remain in their initial position connected to the cartridge case 16 that, due to the effect of the pressure generated in the cartridge chamber 27 by the shot, sticks closely to the walls of the chamber itself.

The relative movement between the extractors 33 and 33', which are fixed, the catches and the breech bolt 18, which moves backwards, is permitted by the sliding of the raised button 35 of the extractors 33 and 33' in the respective elongated sections 41 of the housings 32. The helical springs 37, applied to the shaft 36 of extractors 33 and 33' rest against the striking surface 42 of the seat 32 of the breech bolt 18 and are charged.

Figure 7:
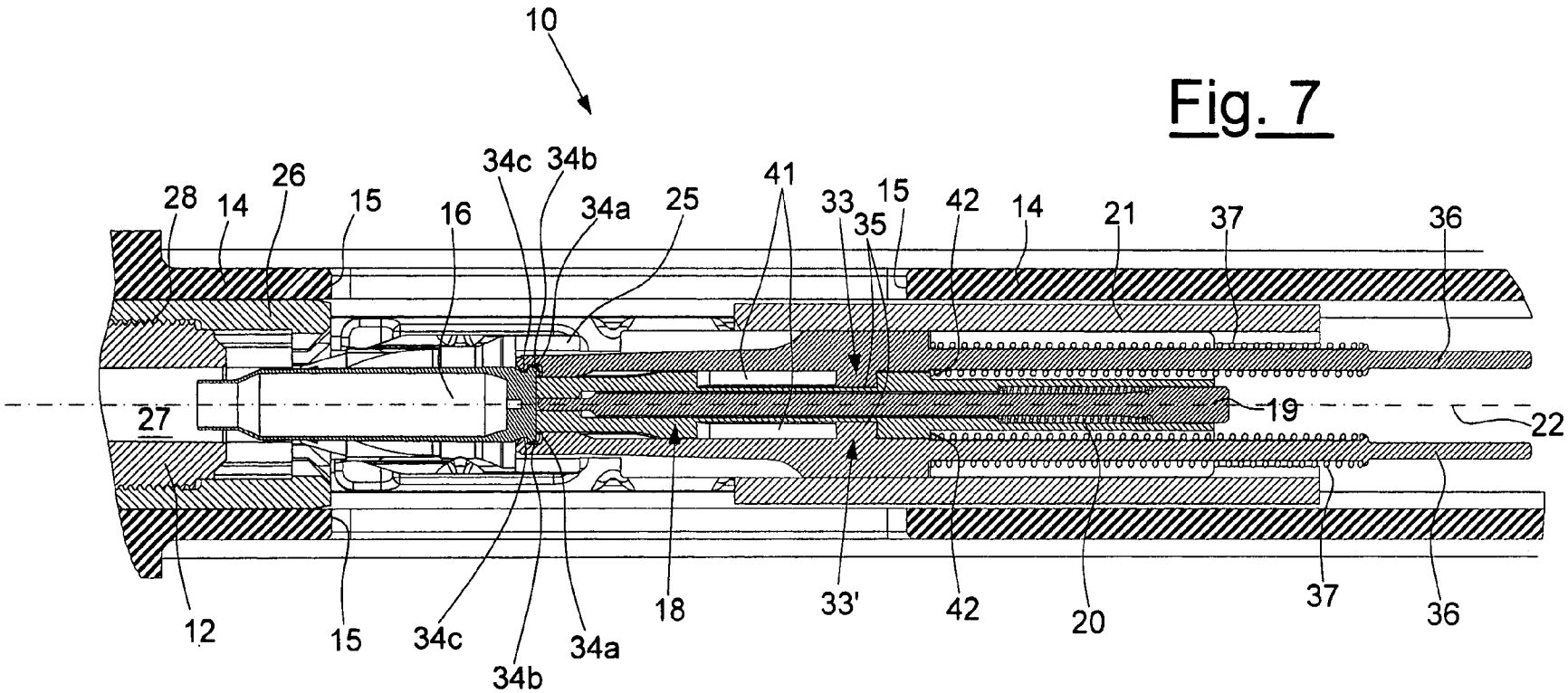

The extraction phase ends in the conditions in FIG. 7, in which the slide 21 is shown drawn further back together with the breech bolt 18. Due to the charge of the springs 37, the extraction is temporarily delayed by a sufficient length of time in order to achieve a reduction in the pressure in the cartridge chamber 27 and therefore slow down the cartridge case 16 with respect to the walls of the same. The extractors 33 and 33', which hold the cartridge case 16 in two substantially opposing points, then slide it out from the cartridge chamber 27. Acting contemporarily on the cartridge case 16, the extractors 33 and 33' share the acting forces leading to an advantage in terms of mechanical stress and sizing of the same. The extractors 33 and 33' can therefore be small in size, a circumstance that, for example, means that the breech bolt 18 threaded head 25, interrupted in correspondence to extractors 33 and 33', will be stronger than usual. Moreover, by acting on the cartridge case 16 in a symmetrical fashion, the loads are distributed symmetrically.

The cartridge case 16 ejection phase (FIG. 8) then gets underway with an initial combined move backwards by the slide 21, breech bolt 18 and extractors 33 and 33' which still hold the cartridge case 16, in order to take the latter into correspondence to the openings 15 in the frame 14.

Depending on the position in which the control component 23 is placed, one of the two extractors, in the figure the left-hand extractor 33', strikes against the stopping surface 46 of the control component 23, thereby acting as an ejector.

The cartridge case 16, which continues to be dragged back, on one side, by the extractor 33 built into the breech bolt 18, is in contact, on the opposite side, with the extractor/ejector 33' that does not change in position, and in particular with the driving surface 34*a*. Subjected to a mechanical torque, the cartridge case 16 rotates and is driven away through the opening 15 opposite the extractor/ejector 33', in the example opening 15 on the right-hand side of the frame 14.

The backwards motion of the slide 21 and the breech bolt 18 compresses the helical spring 37 of the extractor/ejector 33' which strikes against the control component 23 (FIG. 9). Finally, when the slide 21 and the breech bolt 18 regain their initial forward positions, the helical spring 37, charged during the ejection of the cartridge case 16, restores the extractor/ejector component 33' to the rest position in FIG. 4.

In order to change the cartridge case extraction and ejection direction and move, for example, from the right-handed gun in FIGS. 4-9 to a left-handed gun, not illustrated, it is sufficient to transfer the control component 23 so that the hole 45 is in line with the left-hand extractor 33.

The firearm with a selection device for right or left-hand cartridge case ejection has the advantage of being comprised of a small number of components that are easy to assemble.

Advantageously, the gun can be reversed by means of a simple operation on the control component, which can be performed outside the frame, without stripping down the gun.

An advantage of the gun subject of this invention is that of carrying out the cartridge case extraction phase with a time delay sufficient for allowing the reduction of pressure in the cartridge chamber.

Another advantage lies in the fact that the extraction forces are shared by two identical extractors which work on opposite sides of the cartridge case.

The firearm with a selection device for right or left-hand cartridge case ejection thus conceived is subject to numerous changes and variants, all covered by the invention; moreover, all the parts can be replaced by technically equivalent components. In practice, any materials and dimensions can be used on the basis of technical requirements.

The invention claimed is:

1. Firearm with selection device for right or left-hand cartridge case ejection comprising:

a barrel (12);

a breech bolt holder slide (21) which acts on an end section (43) in which is inserted an ejection control component (23);

a breech bolt (18) fitted with firing pin (19);

a frame (14) fitted with openings on both sides (15) for ejecting the cartridge case (16); wherein said selection device comprises two sliding extractors (33, 33'), housed in housings (32) on opposite sides of the breech bolts (18);

said ejection control component (23), in which said extractors (33, 33') comprise an engagement terminal (34), suitable for acting on said cartridge case (16); and a shaft (36) protruding out from the back of said breech bolt (18) and extending into said control component (23), said shaft (36) bearing a helical spring (37), wherein said control component (23) is placed in a mobile position on said frame (14) behind said slide (21) and comprises, on the side turned towards said slide (21);

a hole (45); and a stopping surface (46) which can be alternatively positioned facing said extractors (33, 33'), said extractor (33') facing said stopping surface (46) being suitable for ejecting said cartridge case (16).

2. Firearm according to claim 1, wherein said extractors (33, 33') and said seats (32) are respectively identical and symmetrical with respect to a median surface (11) of said breech bolt (18).

3. Firearm according to claim 1, wherein said extractors (33, 33') comprise a raised button (35) and that said housings (32) comprise a hollow (41) suitable for guiding the sliding motion of said raised button (35).

4. Firearm according to claim 1, wherein said seats (32) comprises striking surfaces (42) for said helical springs (37) of said extractors (33, 33').

5. Firearm according to claim 1, wherein said breech bolt (18) has a closure head comprising a threaded band (25) and an adjacent groove (29), suitable for engaging with a matching section of a small receiver (26) built into said barrel (12).

6. Firearm according to claim 5, wherein said extractor (33, 33') comprises a threaded section (48) at one end fitted with said engagement terminal (34) suitable for finishing said threaded band (25) of said breech bolt (18) when the breech bolt (18) is closed.

7. Firearm according to claim 1, wherein said engagement terminal (34) comprises a driving surface (34*a*) suitable for engaging with a rim (39) of said cartridge case (16).

8. Firearm according to claim 1, wherein said engagement terminal (34) comprises an extractor bent (34*c*) suitable for engaging with an annular support hole (38) of said cartridge case (16).

9. Firearm according to claim 1, wherein said control element (23) is a block inserted crossways into an end section (43) built into said frame (14) against which said slide (21) strikes.

10. Firearm according to claim 9, wherein said end section (43) comprises two through holes (44) running parallel to the axis (22) of the gun and through which the end sections of said extractor (33, 33') shafts (36) can run freely during the backwards movement of said slide (21).

* * * * *